US010910739B2

(12) United States Patent
Haga

(10) Patent No.: US 10,910,739 B2
(45) Date of Patent: Feb. 2, 2021

(54) COAXIAL CABLE CONNECTOR PROVIDED WITH A HOUSING COMPRISING PAIRED CRIMPING PIECES

(71) Applicant: Hirose Electric Co., Ltd., Tokyo (JP)

(72) Inventor: Yujin Haga, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/714,454

(22) Filed: Dec. 13, 2019

(65) Prior Publication Data

US 2020/0203859 A1 Jun. 25, 2020

(30) Foreign Application Priority Data

Dec. 21, 2018 (JP) ..... 2018-239703

(51) Int. Cl.
*H01R 9/05* (2006.01)
*H01R 13/502* (2006.01)

(52) U.S. Cl.
CPC ..... *H01R 9/0518* (2013.01); *H01R 13/502* (2013.01)

(58) Field of Classification Search
CPC ..... H01R 24/38; H01R 13/502; H01R 9/0518
USPC ..... 439/585, 578
See application file for complete search history.

(56) References Cited

U.S. PATENT DOCUMENTS 5,482,477 A * 1/1996 Michael ..... H01R 9/0515 439/108
6,372,990 B1 * 4/2002 Saito ..... H01R 9/0515 174/74 R
6,533,609 B2 * 3/2003 Koide ..... H01R 9/0518 439/578
8,734,179 B2 * 5/2014 Tsai ..... H01R 4/48 439/394
8,939,794 B2 * 1/2015 Mason ..... H01R 13/6275 439/581
9,059,521 B2 * 6/2015 Chen ..... H01R 9/0503
9,160,151 B2 * 10/2015 Vinther ..... H01R 43/00
9,203,196 B2 * 12/2015 Hirakawa ..... H01R 24/50
(Continued)

FOREIGN PATENT DOCUMENTS

JP 6379403 B2 8/2018

*Primary Examiner* — Alexander Gilman
(74) *Attorney, Agent, or Firm* — Procopio, Cory, Hargreaves & Savitch LLP

(57) ABSTRACT

The connector involves a terminal, a housing that supports the terminal, and an outer conductor shell covering at least a portion of the exterior of the housing. The terminal involves a mounting surface exposed from the housing. The housing involves paired crimping pieces provided on opposed sides sandwiching the mounting surface to permit rotation toward the mounting surface, centered about folds. The respective paired crimping pieces include opposed faces that are opposed to the mounting surface when the paired crimping pieces are rotated and abutting faces brought into abutment against counterpart crimping pieces when the paired crimping pieces are rotated. An imaginary plane passing through folds provided on opposed sides that sandwich the mounting surface is positioned in closer proximity to the opposed faces than to the mounting surface in the facing direction in which the mounting surface and the opposed faces are opposed when the paired crimping pieces rotate.

11 Claims, 12 Drawing Sheets

(56) References Cited

U.S. PATENT DOCUMENTS

| | | | | |
|---|---|---|---|---|
| 9,318,835 | B2 * | 4/2016 | Chen | H01R 13/6597 |
| 9,425,564 | B2 * | 8/2016 | Yamaguchi | H01R 13/6592 |
| 9,490,591 | B2 * | 11/2016 | Yamashita | H01R 24/40 |
| 9,793,623 | B2 * | 10/2017 | Chen | H01R 9/0515 |
| 9,960,550 | B2 * | 5/2018 | Ensley | H01R 13/631 |
| 10,581,205 | B2 * | 3/2020 | Yang | H01R 13/6594 |
| 10,601,190 | B2 * | 3/2020 | Huang | H01R 43/205 |
| 10,622,742 | B2 * | 4/2020 | Chen | H01R 13/652 |
| 2010/0062640 | A1 * | 3/2010 | Maruyama | H01R 24/54 439/582 |
| 2012/0295477 | A1 * | 11/2012 | Funahashi | H01R 24/545 439/578 |
| 2016/0164199 | A1 * | 6/2016 | Hashimoto | H01R 9/0518 439/578 |
| 2019/0086442 | A1 * | 3/2019 | Kenzaki | H01R 24/38 |
| 2019/0260168 | A1 * | 8/2019 | Okada | H01R 43/048 |

* cited by examiner (a)

(b)

(a)

(b)

(a)

(b)

(a)

(b)

COAXIAL CABLE CONNECTOR PROVIDED WITH A HOUSING COMPRISING PAIRED CRIMPING PIECES

CROSS-REFERENCE TO RELATED APPLICATIONS

This application claims priority to Japanese Patent Application No. 2018-239703, filed Dec. 21, 2018, the contents of which are incorporated herein by reference in its entirety for all purposes.

BACKGROUND

Technical Field

The present invention relates to a coaxial cable connector, and, more particularly, to a coaxial cable connector provided with a housing comprising paired crimping pieces.

Related Art

An exemplary conventional coaxial cable connector is illustrated in Japanese Patent No. 6,379,403 (Patent Document 1). This coaxial cable connector consists essentially of a terminal, a housing that supports the terminal, and an outer conductor shell that covers at least a portion of the exterior of the housing. A portion of the terminal is provided exposed from the housing as a contact portion that is brought in contact with a terminal in a counterpart coaxial cable and, in addition, as a mounting surface on which the core wire of the coaxial cable is mounted. The housing comprises paired crimping pieces provided on each of the opposed sides that sandwich the mounting surface, in a manner permitting rotation toward the mounting surface, centered about folds. The core wire of a coaxial cable mounted to the mounting surface can be crimped and connected to the mounting surface by rotating the crimping pieces toward the mounting surface. For example, such crimping and connection can be accomplished by crimping (deforming) a portion of the outer conductor shell toward the counterpart coaxial cable and, accordingly, rotating the crimping pieces through abutment against said portion.

In addition to an opposed face, which opposes the mounting surface when the paired crimping pieces are rotated, each crimping piece includes an abutting face, which is brought into abutment and allowed to collide with a counterpart crimping piece. On each of these abutting faces there are provided recessed and convex portions complementary to recessed and convex portions on a counterpart crimping piece, and bringing these recessed and convex portions into engagement allows for connecting, holding, and securing the core wire of the coaxial cable to the terminal without protrusion beyond the crimping pieces.

RELATED ART DOCUMENT

Patent Documents

[Patent Document 1]
Japanese Patent No. 6,379,403.

SUMMARY

Problems to be Solved

In the configuration of Patent Document 1, due to the fact that the mounting surface and the folds were positioned in substantially the same plane in the facing direction, i.e., the direction in which the mounting surface faces the opposed faces of the crimping pieces when the crimping pieces were rotated, when attempting to crimp the core wire of a relatively large coaxial cable, the force that is meant to be applied in the facing direction was dispersed in other directions. As a result, the crimping pieces in particular were subjected to forces driving the pieces away from each other and, consequently, the crimped portion of the core wire of the coaxial cable was not adequately covered by the crimping pieces, which raised concern about defective crimping.

It is an object of the disclosure herein to provide a coaxial cable connector in which even relatively large coaxial cables can be properly crimped by effectively applying forces acting in the facing direction using a coaxial cable positioned between a mounting surface and opposed faces. The invention of the present Application has been devised to solve such problems of the prior art and it is an object of the invention to provide a coaxial cable connector that makes it possible to properly crimp a relatively large coaxial cable by effectively applying forces acting in the facing direction using a coaxial cable positioned between the mounting surface and the opposed faces.

Technical Solution

The inventive coaxial cable connector is characterized by the fact that the connector is provided with a terminal, a housing supporting the terminal, and an outer conductor shell covering at least a portion of the exterior of the housing, wherein the terminal comprises a mounting surface exposed from the housing; the housing comprises paired crimping pieces provided on opposed sides that sandwich the mounting surface so as to permit rotation toward the mounting surface, centered about folds; the paired crimping pieces include, respectively, opposed faces that are opposed to the mounting surface when the paired crimping pieces are rotated and abutting faces brought into abutment against counterpart crimping pieces when the paired crimping pieces are rotated; and an imaginary plane that passes through folds provided on opposed sides that sandwich the mounting surface is positioned in closer proximity to the opposed faces than to the mounting surface in the facing direction in which the mounting surface and the opposed faces are opposed when the paired crimping pieces are rotated.

With this configuration, a coaxial cable connector is provided in which even relatively large coaxial cables can be properly crimped by effectively applying forces acting in the facing direction using a coaxial cable positioned between the mounting surface and the opposed faces.

It should be noted that, in the above-mentioned coaxial cable connector, the opposed faces that are opposed to the mounting surface when the paired crimping pieces are rotated and the abutting faces brought into abutment with the counterpart crimping pieces when the paired crimping pieces are rotated may be adapted to be capable of colliding with each other.

In the coaxial cable connector of the embodiment described above, the angle centered about the folds formed by the opposed faces and the imaginary plane, when the abutting faces of the paired crimping pieces are brought into abutment and allowed to collide, is preferably set to 45 degrees or less.

In addition, in the coaxial cable connector of the embodiment described above, the housing may have a recessed groove in which the mounting surface is disposed, and may have the above-mentioned folds at the opening of the recessed groove.

Furthermore, in the coaxial cable connector of the embodiment described above, recessed portions that engage with convex portions provided on the abutting faces of the counterpart crimping pieces when the paired crimping pieces are rotated may be provided on at least any one of the abutting faces of the paired crimping pieces.

In addition, in the coaxial cable connector of the embodiment described above, covering portions that cover the engagement portions of the convex portions and the recessed portions may be provided on the side of the recessed portions opposite to the opposed faces.

In addition, the coaxial cable connector of the embodiment described above, the covering portions of the paired crimping pieces may be adapted to collide when the paired crimping pieces are rotated.

Furthermore, in the coaxial cable connector of the embodiment described above, the thickness in the facing direction of the terminal on the mounting surface may be made to be different from the thickness in the facing direction in the section of the terminal adjacent to the mounting surface.

In addition, in the coaxial cable connector of the embodiment described above, the mounting surface may be brought into closer proximity to the opposed faces than the section of the terminal adjacent to the mounting surface by making the thickness in the facing direction of the terminal on the mounting surface smaller than the thickness in the facing direction in the section of the terminal adjacent to the mounting surface.

In addition, in the coaxial cable connector of the embodiment described above, the thickness in the facing direction of the terminal on the mounting surface may be made smaller than the thickness in the facing direction in the section of the terminal adjacent to the mounting surface by providing a depressed indentation in the mounting surface.

In addition, in the coaxial cable connector of the embodiment described above, protruding portions that protrude toward the opposed faces may be provided in a portion of the mounting surface. [Technical Effect]

In accordance with the present invention, a coaxial cable connector is provided in which even relatively large coaxial cables can be properly crimped by effectively applying forces acting in the facing direction using a coaxial cable positioned between a mounting surface and the opposed faces.

A perspective view of the inventive coaxial cable connector.

FIG. 2

An exploded perspective view of the coaxial cable connector.

FIG. 3

A perspective view illustrating a state immediately preceding the deformation of the paired crimping pieces toward the coaxial cable.

FIG. 4

Figure 3:
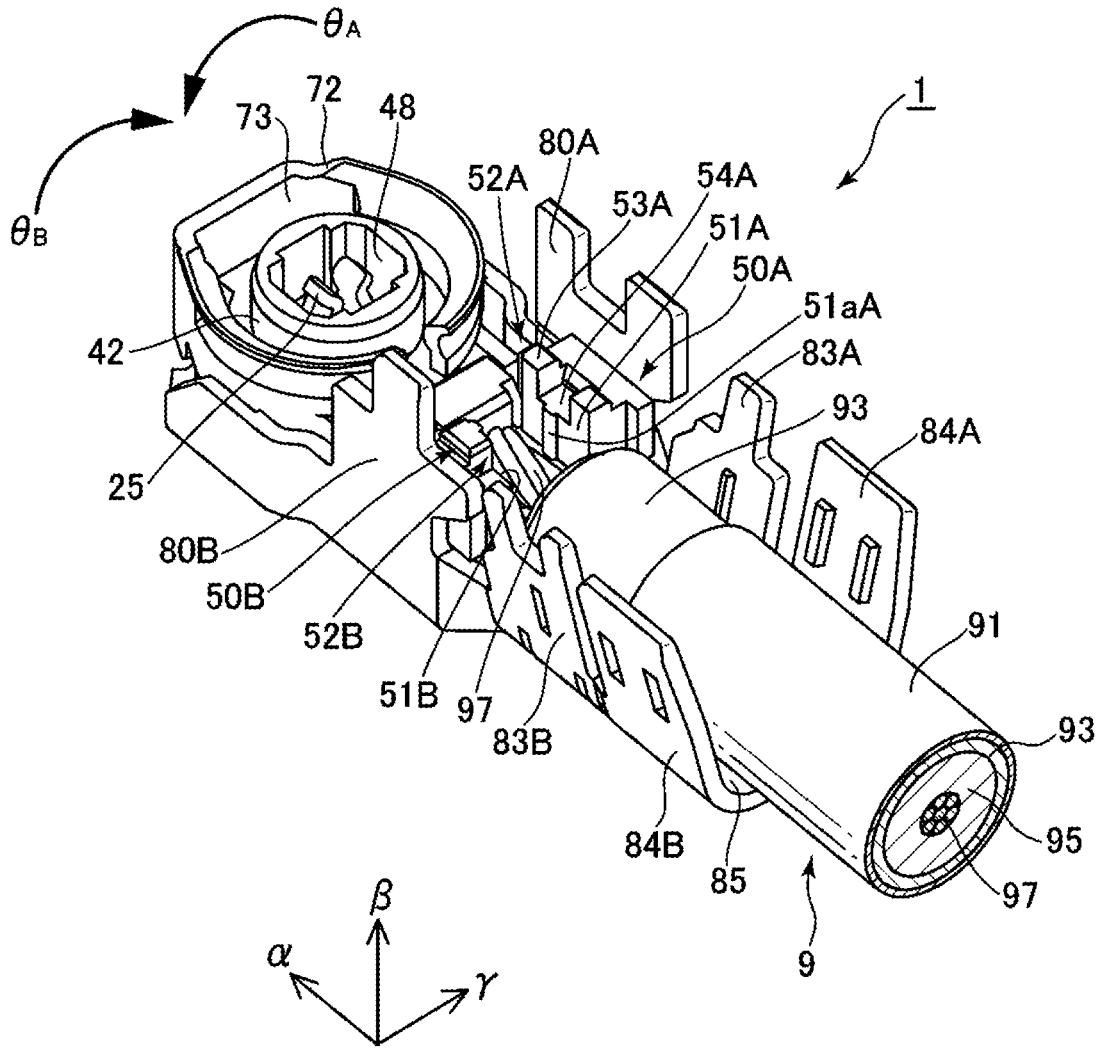

A plan view illustrating the state shown in FIG. 3.

Figure 5A:
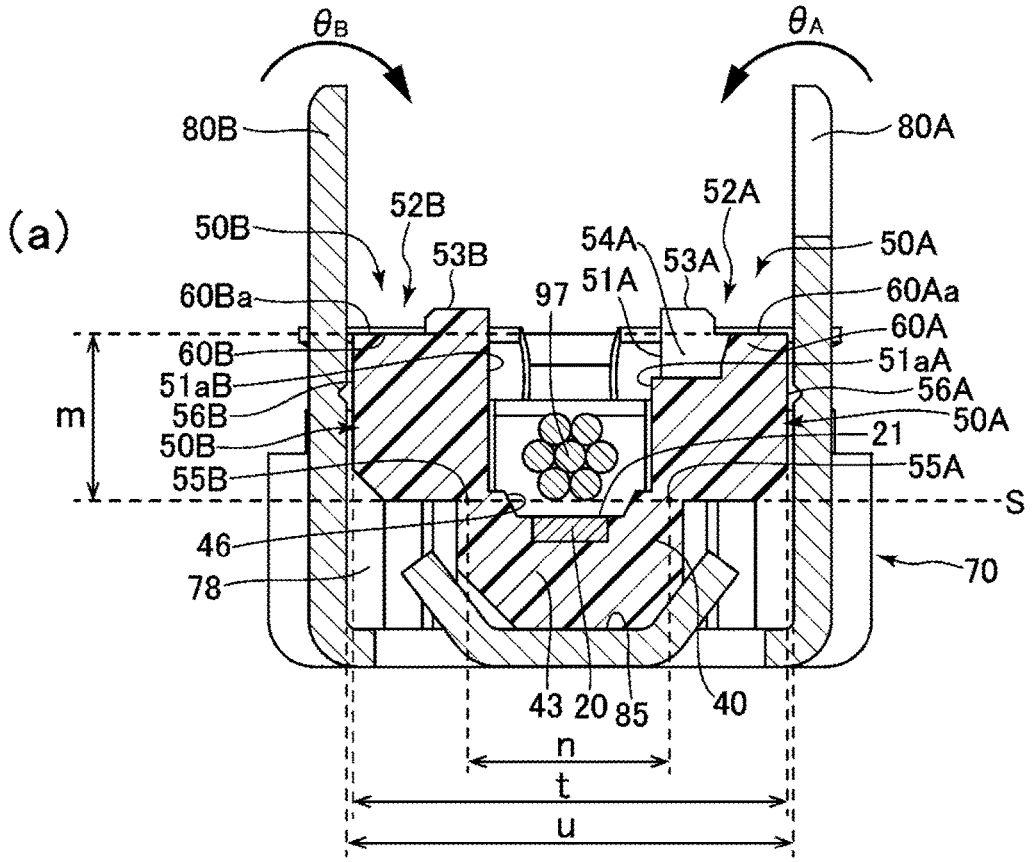
Figure 5B:
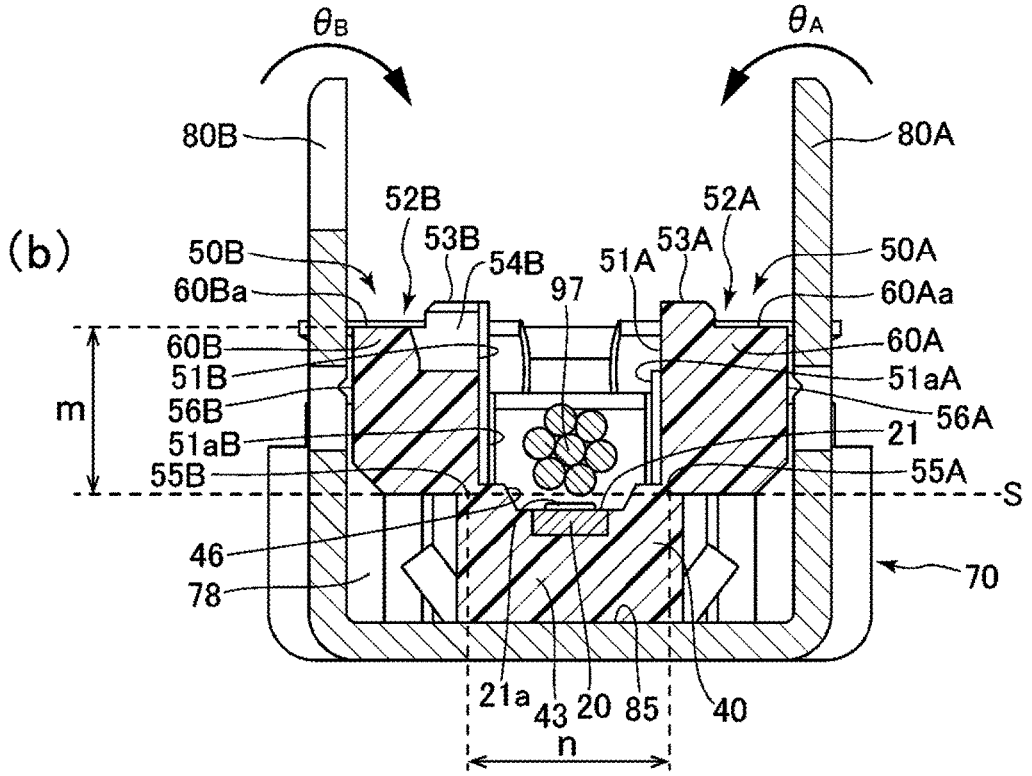

FIGS. 5(*a*) and 5(*b*)

Figure 4:
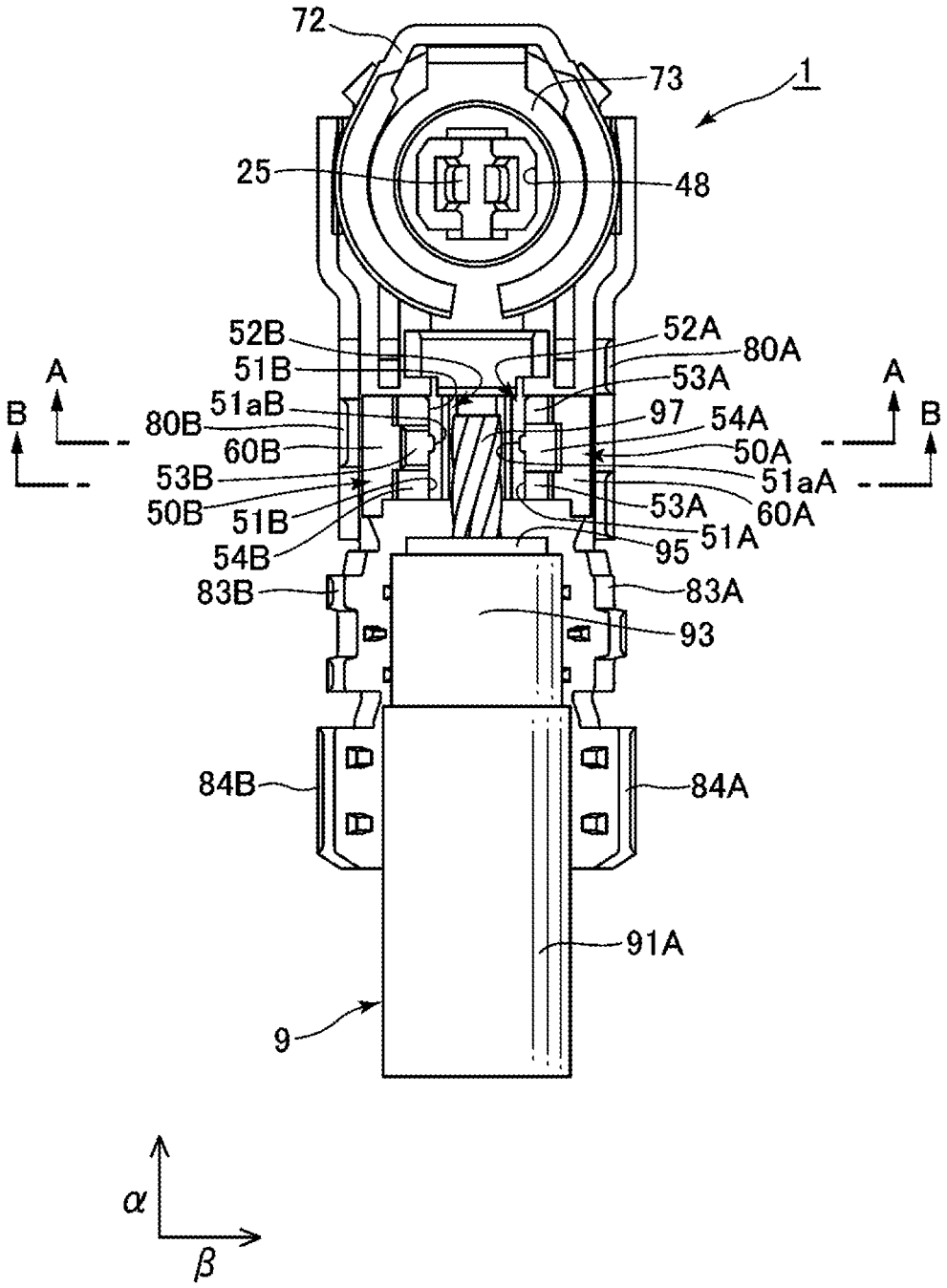

A drawing illustrating the state of the paired crimping pieces during rotation in a step-by-step manner that shows a cross-sectional view taken along line A-A and a cross-sectional view taken along line B-B in FIG. 4.

Figure 6A:
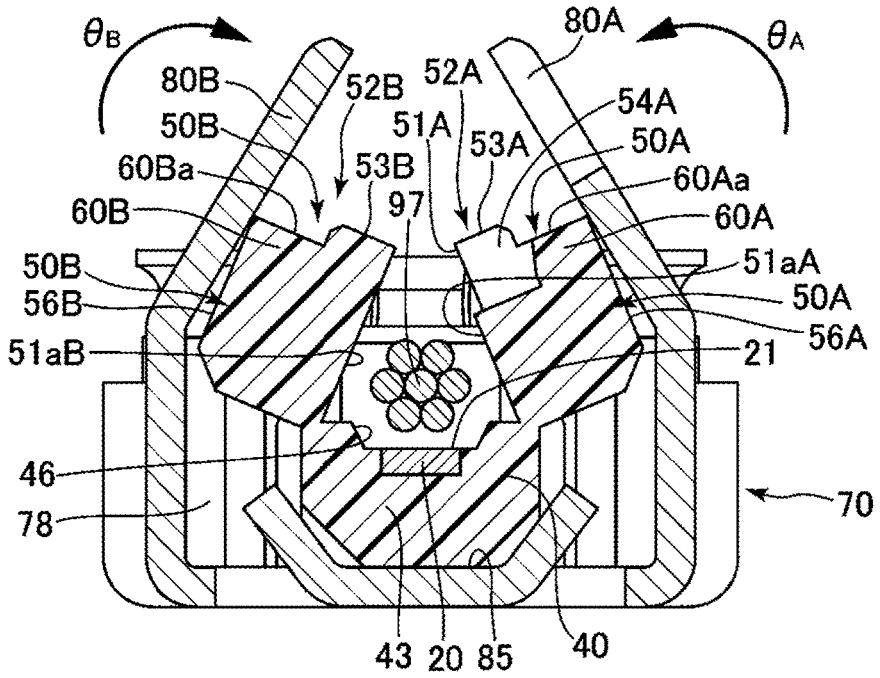
Figure 6B:
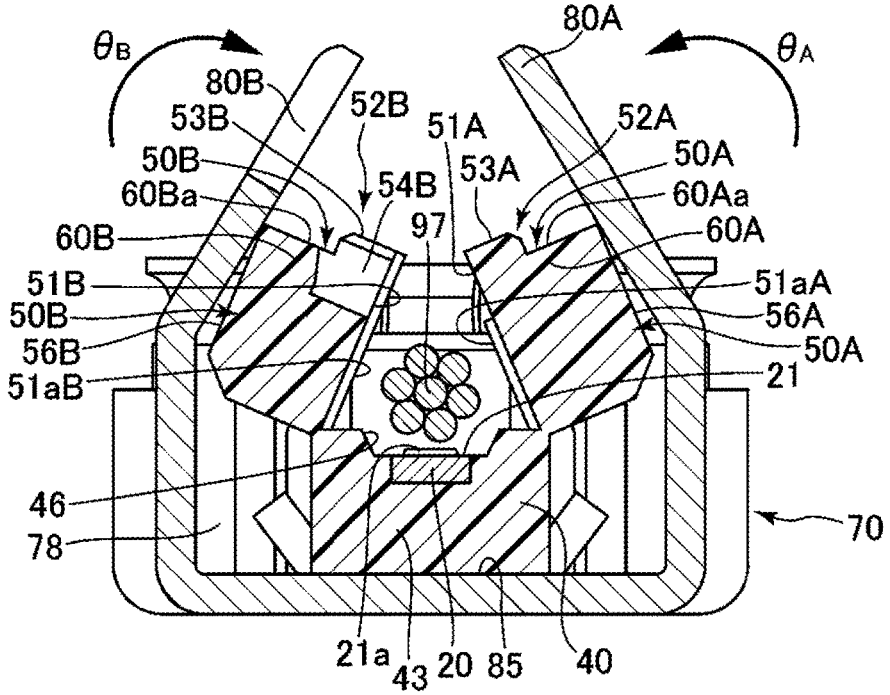

FIGS. 6(*a*) and 6(*b*)

A drawing illustrating the state of the paired crimping pieces during rotation in a step-by-step manner that shows a cross-sectional view taken along line A-A and a cross-sectional view taken along line B-B in FIG. 4.

Figure 7A:
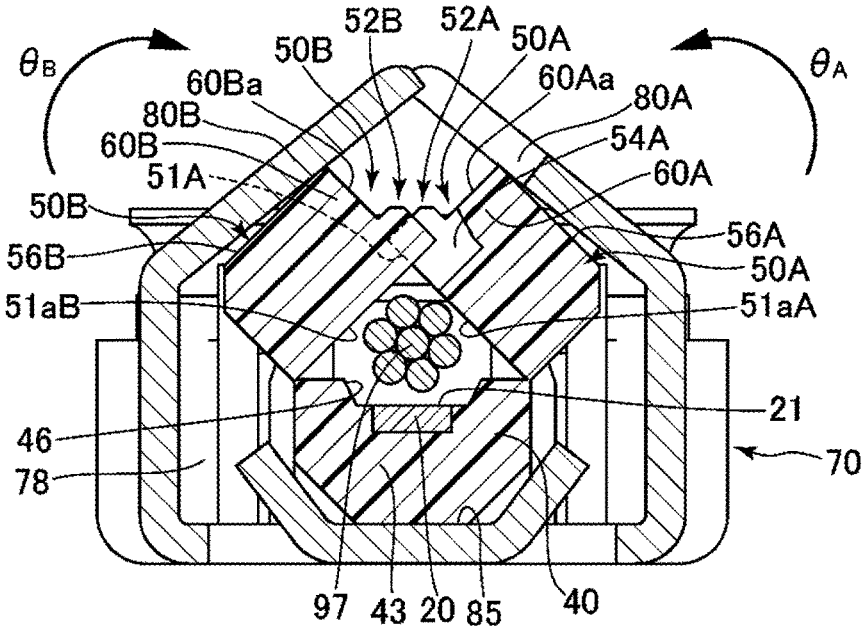
Figure 7B:
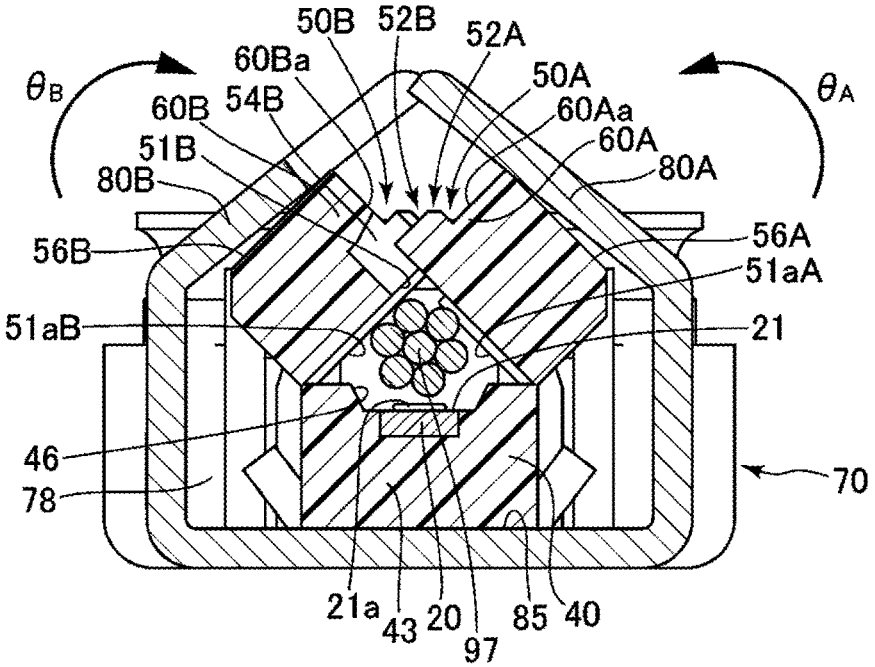

FIGS. 7(*a*) and 7(*b*)

A drawing illustrating the state of the paired crimping pieces during rotation in a step-by-step manner that shows a cross-sectional view taken along line A-A and a cross-sectional view taken along line B-B in FIG. 4.

Figure 8A:
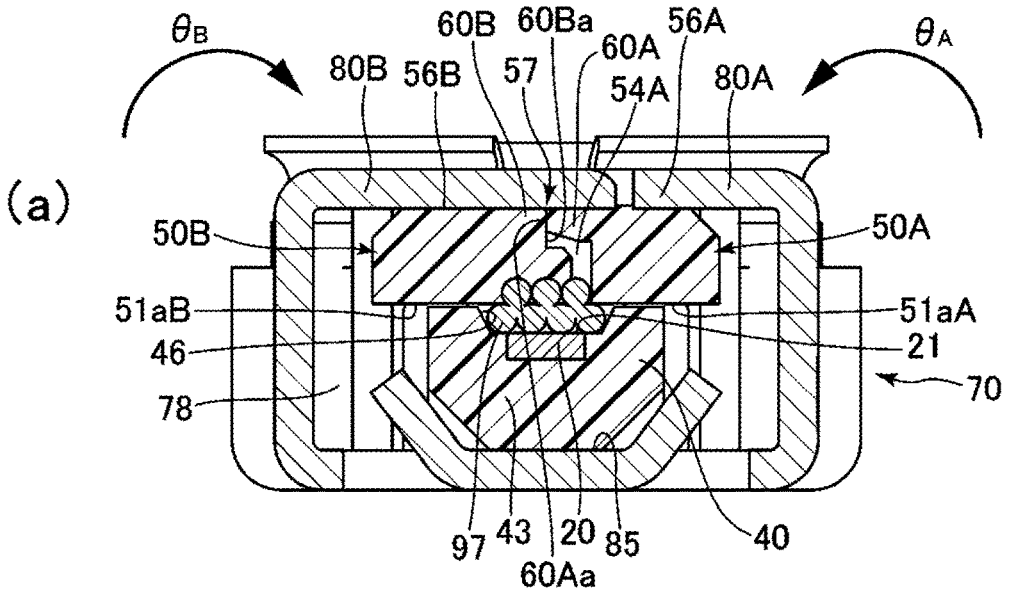
Figure 8B:
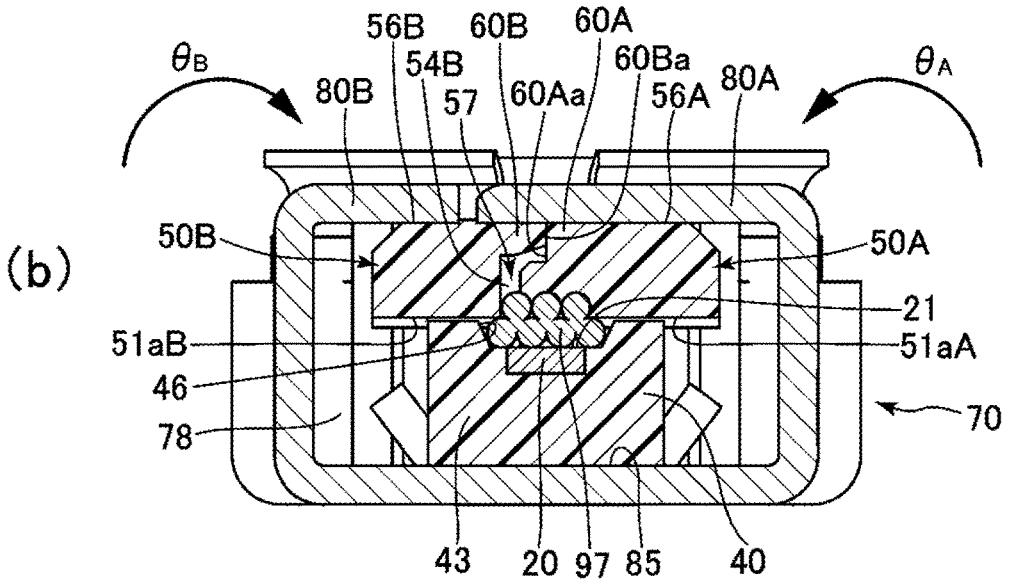

FIGS. 8(*a*) and 8(*b*)

A drawing illustrating the state of the paired crimping pieces during rotation in a step-by-step manner that shows a cross-sectional view taken along line A-A and a cross-sectional view taken along line B-B in FIG. 4.

Figure 9A:
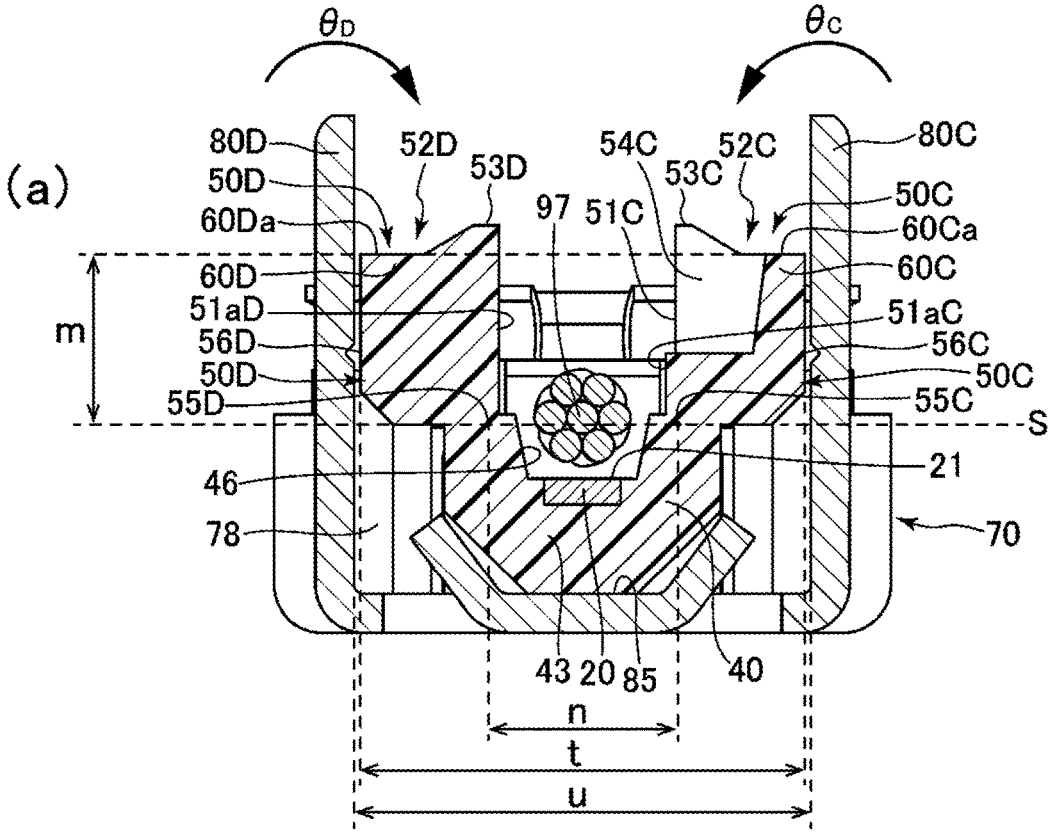
Figure 9B:
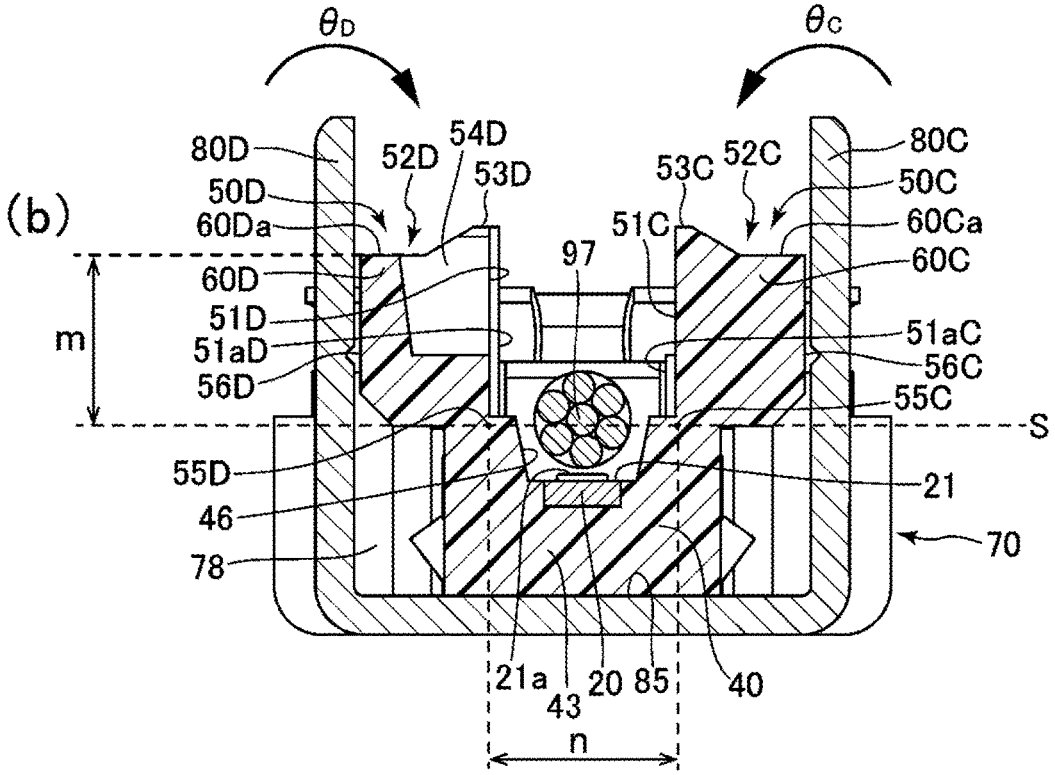

FIGS. 9(*a*) and 9(*b*)

A drawing illustrating a variation that shows a cross-sectional view corresponding to FIG. 5.

Figure 10A:
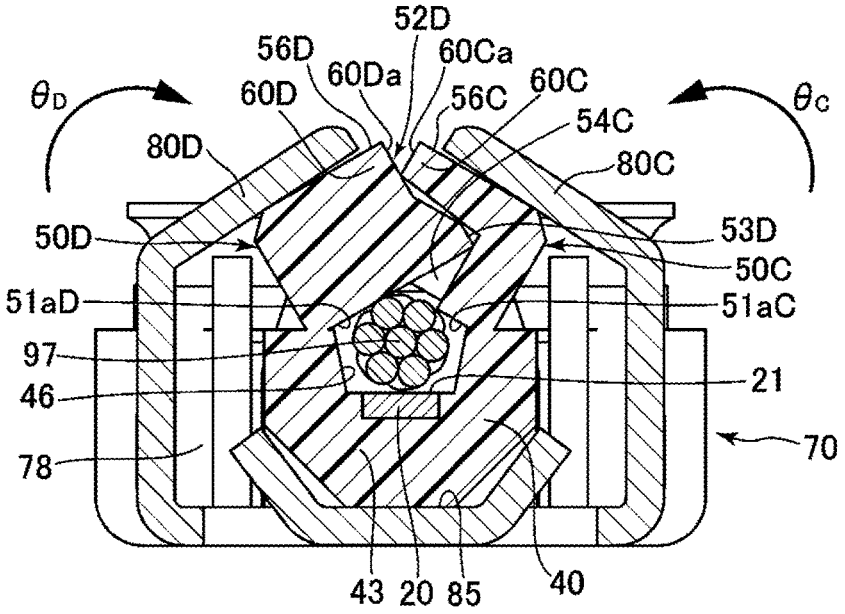
Figure 10B:
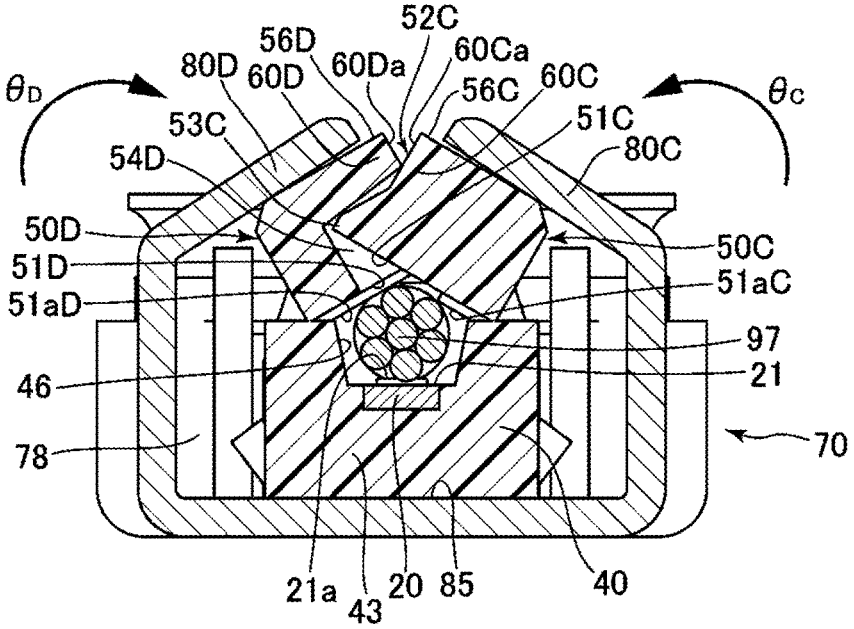

FIGS. 10(*a*) and 10(*b*)

A drawing illustrating a variation that shows a cross-sectional view corresponding to FIG. 7.

Figure 11A:
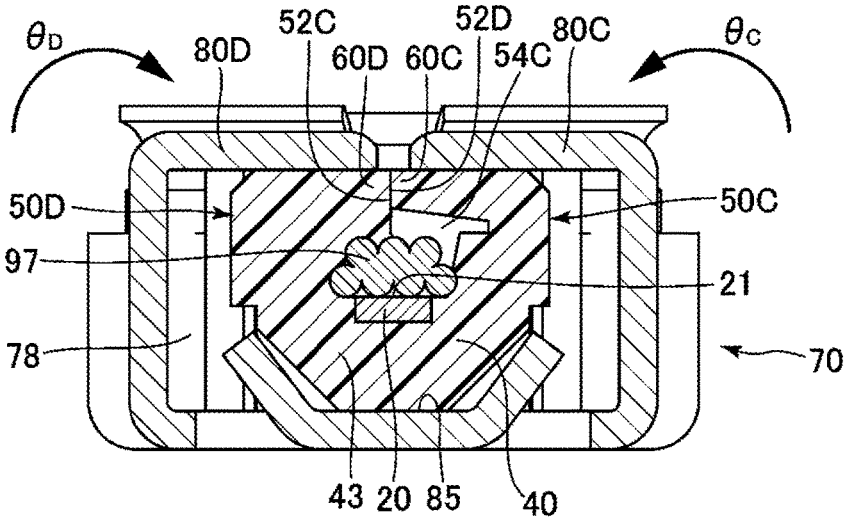
Figure 11B:
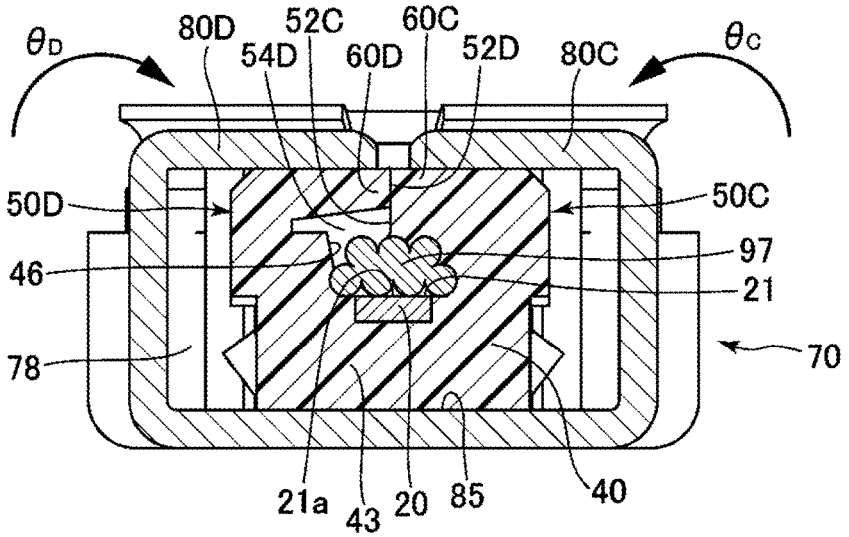

FIGS. 11(*a*) and 11(*b*)

A drawing illustrating a variation that shows a cross-sectional view corresponding to FIG. 8.

FIG. 12

A partial cutaway cross-sectional view illustrating an example of a mounting surface used to regulate impedance.

DETAILED DESCRIPTION

A preferred embodiment of the present invention will be described below with reference to the accompanying drawings. While the discussion below specifically refers to the so-called right-angle coaxial connectors, the present invention is not limited thereto and, for instance, can also be applied to cable connectors of the vertical type.

Figure 1:
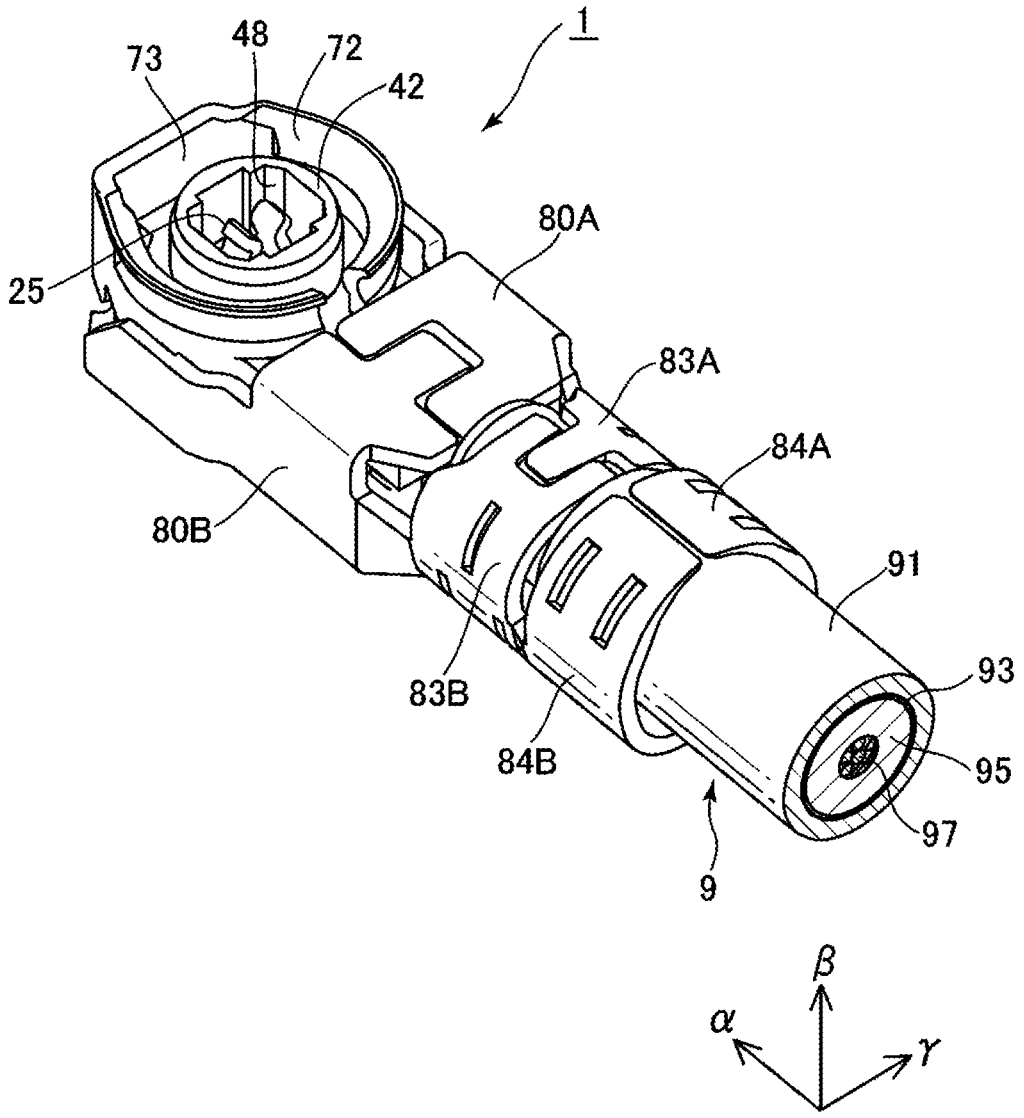
FIG. 1
Figure 2:
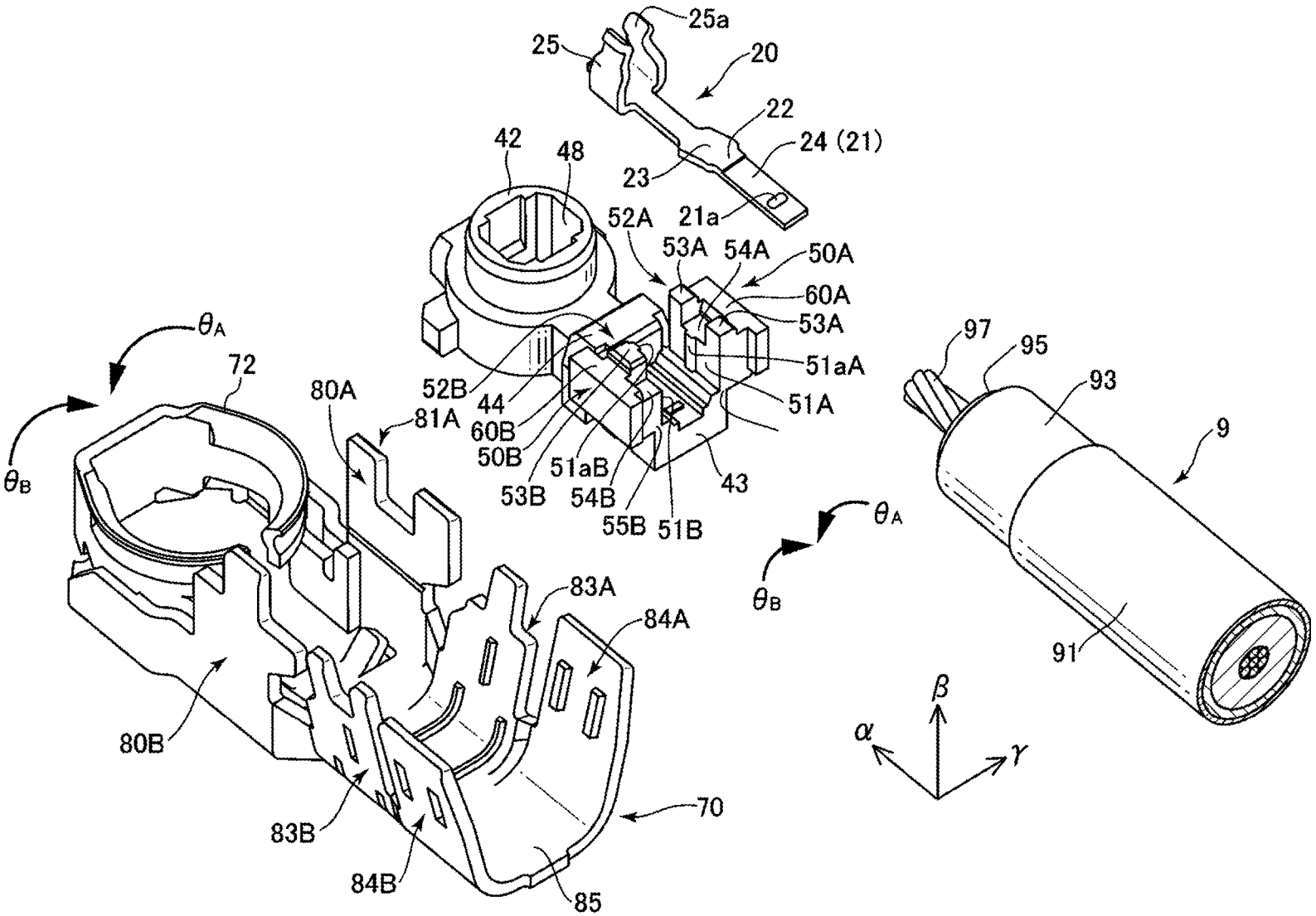

A perspective view of the inventive coaxial cable connector 1 is shown in FIG. 1 and its exploded perspective view is shown in FIG. 2. The coaxial cable connector 1 can be mated with a counterpart coaxial connector (not shown in the drawing) in the mating direction "β".

The coaxial cable connector 1, which extends along an axial centerline in the "α" direction and has a bilaterally symmetrical shape, is provided with an electrically conductive terminal 20, an insulative housing 40 that supports the terminal 20, and an outer conductor shell 70 that covers at least a portion of the exterior of the coaxial cable (not shown in the drawing) and the housing 40.

The terminal 20 has a predetermined length in the axial direction "α" of the coaxial cable 9 secured to the coaxial cable connector 1. The coaxial cable 9 is of the same construction as an ordinary conventional coaxial cable; in other words, it has an insulating jacket 91, an outer conductor 93, an insulator (braid) 95, and a core wire 97 arranged in the direction from the outermost shell to the center. The core wire 97 is exposed at one end of the coaxial cable 9. A contact portion 25, which is placed in contact with a center terminal in a counterpart coaxial connector, is provided at the distal end of the terminal 20. Portions, 25*a*, of the contact portion 25, which are raised toward the side of contact with a counterpart coaxial connector and are formed as paired resilient pieces allowing for the center terminal of the counterpart coaxial connector to be inserted and sandwiched therebetween. A connecting portion 24, which is connected to the core wire 97 exposed at one end of the coaxial cable 9, is provided at the rear end of the terminal 20. A mounting surface 21, to which the core wire 97 of the coaxial cable is mounted, is formed on the surface of the connecting portion 24. A wide stepped portion 23, which has a step in the mating direction "β" and also expands in the width direction "γ", is provided between the contact portion 25 and the connecting portion 24. As a result of providing a step in the mating direction "β", the rear end side (24) of the terminal 20 in the integrally molded housing 40 is located closer to the coaxial cable than the front end side (25), while the front end side (25) of the terminal 20 is located closer to the arrangement surface 85 of the outer conductor shell 70 than the rear end side (24).

The outer conductor shell 70 is formed by stamping and folding from a piece of sheet metal. The outer conductor shell 70 consists essentially of the arrangement surface 85, on which the housing 40 and the coaxial cable 9 are disposed, a substantially cylindrical mating portion 72 provided at the distal end of this arrangement surface 85, as well as multiple crimping portions, more specifically, an enclosing portion 80, which is positioned at a corresponding location of the connecting portion 24 along the axial direction "α", and, also, an outer conductor crimping portion 83 and a jacket crimping portion 84, which are disposed so as to be spaced apart from one another along the axial direction "α" from one end toward the other end of the coaxial cable 9 connected to the connecting portion 24.

At the time of mating with a counterpart coaxial connector, the mating portion 72 is connected to the cylindrical shell of the counterpart coaxial connector (not shown in the drawing). The cylindrical shell of the counterpart coaxial connector is inserted into a gap 73 formed between the mating portion 72 of the outer conductor shell 70 and the mating portion 42 of the housing 40.

The enclosing portion 80, the outer conductor crimping portion 83, and the jacket crimping portion 84 are respectively comprised by paired crimping pieces provided so as to permit deformation toward the coaxial cable 9 connected to the connecting portion 24, these being enclosing pieces 80A, 80B, outer conductor crimping pieces 83A, 83B, and jacket crimping pieces 84A, 84B. FIG. 3 is a perspective view illustrating a state immediately preceding the deformation of these paired crimping pieces toward the coaxial cable 9, and FIG. 4 is a plan view thereof. Here (and elsewhere), the letters "A" and "B" indicate the right and left sides.

In each pair, the crimping pieces that constitute each pair are disposed respectively on each of the opposed sides that sandwich the arrangement surface 85, in other words, on each of the opposed sides that sandwich the connecting portion 24 (mounting surface 21). The enclosing pieces 80A, 80B are intended mainly for securing the core wire 97 of the coaxial cable by crimping the crimping pieces 50A, 50B of the housing 40, the outer conductor crimping pieces 83A, 83B are intended mainly for crimping the outer conductor 93 of the coaxial cable 9, and the jacket crimping pieces 84A, 84B are intended mainly for crimping the insulating jacket 91 of the coaxial cable 9. When the coaxial cable 9 is disposed in the outer conductor shell 70, the core wire 97 of the coaxial cable 9 is mounted to the mounting surface 21 of the terminal 20 and positioned at a location corresponding to the enclosing pieces 80A, 80B, the outer conductor 93 of the coaxial cable 9 is positioned at a location corresponding to the outer conductor crimping pieces 83A, 83B, and, in addition, the insulating jacket 91 of the coaxial cable 9 is positioned at a location corresponding to the jacket crimping pieces 84A, 84B. The crimping pieces that constitute each pair are deformed at the respective locations toward the coaxial cable 9 in the "$\theta_A$" or "$\theta_B$" direction and are crimped onto said coaxial cable 9.

The housing 40 consists essentially of a main body portion 44 that has a substantially cubic shape, a cylindrical mating portion 42 provided at the distal end of the main body portion 44, a mounting portion 43 provided at the rear end of the main body portion 44, and, in addition, paired crimping pieces 50A, 50B. Each of these components is molded integrally with the terminal 20 using a plastic molding process. However, even after integral molding, a portion of the terminal 20, for example, at least a portion of the contact portion 25 (resilient pieces 25*a* and the like) and at least a portion of the connecting portion 24 (mounting surface 21) remains exposed to the outside environment.

The mating portion 42, which is a section protruding toward the side of contact with the counterpart coaxial connector, has the contact portion 25 of the terminal 20 disposed in the indentation 48 provided in its center. At the time of mating with the counterpart coaxial connector, the mating portion 42 is inserted into the cylindrical shell of the counterpart coaxial connector and, moreover, the center terminal disposed in the center of the cylindrical shell is inserted into and brought in contact with the contact portion 25 disposed in the center of the mating portion 42.

The paired crimping pieces 50A, 50B are provided on the opposed sides that sandwich the mounting surface 21 in a manner permitting rotation centered, respectively, about folds 55A, 55B that extend along the axial direction "α" of the coaxial cable toward the mounting surface 21, i.e., in the directions "$\theta_A$" and "$\theta_B$" illustrated in the drawing. These crimping pieces 50A, 50B respectively include opposed faces 51A, 51B (surfaces formed by the "α" and "β" directions in FIGS. 2 to 4) opposing the mounting surface 21 when the paired crimping pieces 50A, 50B are rotated and abutting faces 52A, 52B (surfaces formed by the "α" and "γ" directions in FIGS. 2 to 4) brought into abutment and collision with the counterpart crimping pieces when the paired crimping pieces 50A, 50B are rotated. Here, the facing direction, in which the mounting surface 21 and the opposed faces 51A, 51B face each other when the paired crimping pieces 50A, 50B are rotated, is substantially identical to the mating direction "β", in which the coaxial cable connector 1 and the counterpart coaxial connector are mated. As a result of collision of at least some portions of the abutting faces 52A, 52B, the core wire 97 of the coaxial cable sandwiched between the mounting surface 21 and the opposed faces 51A, 51B in the facing direction"β" can be efficiently prevented from escaping from the gap of the abutting faces 52A, 52B.

Protruding portions 51*a*A, 51*a*B, which protrude toward the mounting surface 21, are respectively provided on the opposed faces 51A, 51B in the "β (or γ)" direction intersecting with the folds 55A, 55B. Providing the protruding portions 51*a*A, 51*a*B can augment the pushing force of the opposed faces 51A, 51B against the mounting surface 21 in the section where these protruding portions 51*a*A, 51*a*B are provided.

A protruding portion 21*a*, which protrudes toward the opposed faces 51A, 51B, may be provided on the mounting surface 21. Providing the protruding portion 21*a* can augment the pushing force of the mounting surface 21 against the opposed faces 51A, 51B.

Recessed portions 54A, 54B, which engage with convex portions 53A, 53B provided on the abutting faces 52B, 52A of the counterpart crimping pieces 50B, 50A when the paired crimping pieces 50A, 50B are rotated, are provided on at least one of the abutting faces 52A, 52B of the paired crimping pieces 50A, 50B. The convex portions 53A, 53B and the recessed portions 54A, 54B may be respectively provided so as be capable of colliding with each other on the abutting sides of the abutting faces 52A, 52B.

In the illustrated example, a total of three portions, i.e., a convex portion 53A, a recessed portion 54A, and a convex portion 53A, are provided in this order in an alternating manner along the direction "α" of the folds 55A, 55B on the abutting face 52A, and, in alignment therewith, a total of three portions, i.e., a recessed portion 54B, a convex portion 53B, and a recessed portion 54B, are similarly provided in this order on the abutting face 52B. There are no specific limitations as to the number of such recessed and convex portions, such that only one recessed or convex portion, or a plurality of recessed and convex portions, may be provided on each of the abutting faces 52A, 52B.

Covering portions 60A, 60B are respectively provided on the sides of the recessed portions 54A, 54B opposite to the opposed faces 51A, 51B. When the paired crimping pieces 50A, 50B are rotated and the convex portions 53B, 53A are brought into engagement with the recessed portions 54A, 54B, these covering portions 60A, 60B can cover the engagement portion 57 of the recessed and convex portions from the top and, moreover, are capable of colliding with each other on the abutting sides of the abutting faces 52A, 52B. Providing such covering portions 60A, 60B can prevent the ingress of dust and the like through gaps that may be produced along the engagement portion 57 by closing such gaps, thus making it possible to increase the contact reliability of the connector.

The action of the paired crimping pieces 50A, 50B will now be described with reference to FIGS. 5 to 8. FIGS. 5 to 8 illustrate the state of the paired crimping pieces 50A, 50B during rotation in a step-by-step manner. In the drawings, (a) corresponds to a cross-sectional view taken along line A-A in FIG. 4, and (b) corresponds to a cross-sectional view taken along line B-B in FIG. 4.

As shown in FIGS. 5(*a*) and 5(*b*), when the crimping pieces 50A, 50B are rotated, the first step is to install the coaxial cable. The core wire 97 of said coaxial cable is mounted to the mounting surface 21 of the terminal 20. The mounting surface 21 is positioned at a location corresponding to the enclosing pieces 80A, 80B of the outer conductor shell 70 in the axial direction "α" of the coaxial cable.

The angle centered about the folds 55A, 55B formed by the mounting surface 21 and the opposed faces 51A, 51B of the paired crimping pieces 50A, 50B during rotation of the crimping pieces 50A, 50B is set to approximately 90 degrees. At such time, the length "t" in the width direction "γ" between the ceiling surface 56A on the opposite side from the opposed face 51A of the crimping piece 50A and the ceiling surface 56B on the opposite side from the opposed face 51B of the crimping piece 50B is configured to be of substantially the same size as the length "u" in the width direction "γ" of the interior space 78 between the enclosing pieces 80A, 80B of the outer conductor shell 70. As a result of using such dimensions, the crimping pieces 50A, 50B initiate rotation simultaneously with the deformation of the enclosing pieces 80A, 80B toward the coaxial cable 9.

As explained above, when the crimping pieces 50A, 50B are rotated, the crimping pieces 50A, 50B are brought into abutment with each other on the abutting sides of the abutting faces 52A, 52B. These abutting faces 52A, 52B may be adapted to permit collision between certain sections of the abutting faces 52A, 52B when brought into abutment with each other or, alternatively, may be adapted such that the abutting faces 52A, 52B are mated with each other without allowing them to collide by bringing the recessed portions 54A, 54B respectively into engagement with the convex portions 53A, 53B. As an example of the former case, e.g., if the covering portions 60A, 60B of the abutting faces 52A, 52B are allowed to collide on these abutting sides, the total distance from the folds 55A, 55B to the collision portions of the abutting faces 52A, 52B, e.g., the collision faces 60A*a*, 60B*a* of the covering portions 60A, 60B, in the example of FIG. 5, "m"×2, is set to the same distance as the distance "n" between the fold 55A and the fold 55B or slightly larger than that. In other words, the (total) distance from the folds 55A, 55B to the collision portions of the abutting faces 52A, 52B is preset to a predetermined size with respect to the distance between the fold 55A and the fold 55B. Here, if the former size is much larger than the latter size, significant loads are applied to the folds 55A, 55B when the crimping pieces 50A, 50B are rotated, as a result of which the folds 55A, 55B are either deformed or broken. There is a risk that such deformation or breakage could weaken the crimping force applied to the core wire 97 of the coaxial cable sandwiched between the mounting surface 21 and the opposed faces 51A, 51B. Accordingly, the former size "m" is preferably the same as the latter size "n", or is imparted slightly larger dimensions than that.

Now, moving from the state illustrated in FIGS. 5(*a*) and 5(*b*) to FIGS. 6(*a*) and 6(*b*), the enclosing pieces 80A, 80B of the outer conductor shell 70 are then rotated in the directions "$\theta_A$" and "$\theta_B$" at each position. As a result, the crimping piece 50A rotates via contact between the ceiling surface 56A and the inner wall of the enclosing piece 80A centered about the fold 55A toward the mounting surface 21 in the direction "$\theta_A$", while the crimping piece 50B rotates via contact between the ceiling surface 56B and the inner wall of the enclosing piece 80B centered about the fold 55B toward the mounting surface 21 in the direction "$\theta_B$". At such time, the opposed face 51A of the crimping piece 50A and the opposed face 51B of the crimping piece 50B are moved toward the side opposing the mounting surface 21, thereby forming faces opposed to the mounting surface 21. In addition, the abutting face 52A of the crimping piece 50A and the abutting face 52B of the crimping piece 50B are moved in the direction of mutual abutment, in other words, the recessed portion 54A of the abutting face 52A and the convex portion 53B of the abutting face 52B are moved toward each other.

In the present embodiment, the imaginary plane "S", which passes through the folds 55A, 55B serving as rotation axes when the crimping pieces 50A, 50B are rotated, is positioned in closer proximity to the opposed faces 51A, 51B than to the mounting surface 21 in the facing direction "β". This creates a space between the mounting surface 21 and the opposed faces 51A, 51B and makes it possible to crimp even a relatively thick core wire 97. In addition, in comparison with prior-art configurations in which the mounting surface and the folds were positioned in substantially the same plane, the fact that in the facing direction "β" the imaginary plane "S" is positioned in closer proximity to the opposed faces 51A, 51B than to the mounting surface 21 makes it possible to delay the timing of collision, or mating, of the collision face 60A*a* formed on the abutting face 52A of the crimping piece 50A and the collision face 60Ba formed on the abutting face 52B of the crimping piece 50B. In other words, it is possible to reduce the angle centered about the folds 55A, 55B formed by each of the opposed faces 51A, 51B and the imaginary plane "S", when the abutting faces 52A, 52B of the crimping pieces 50A, 50B are brought into abutment and allowed to collide or when they are mated. For this reason, the dispersion of the force component directed in the direction "β" toward the mounting surface 21 and applied to the ceiling surface 56A of the crimping piece 50A and the ceiling surface 56B of the crimping piece 50B in the "γ" direction perpendicular thereto is reduced, thereby providing for more efficient transmission in the direction "β". Here, the angle centered about the folds 55A, 55B formed by each of the opposed faces 51A, 51B and the imaginary plane "S" is preferably 45 degrees or less, more preferably 35 degrees or less, and even more preferably 25 degrees or less. Since the imaginary plane "S" is positioned closer to opposed faces 51A, 51B than to the mounting surface 21 in the facing direction "β", as an embodiment, the housing 40 may be provided, for example, with a recessed groove 46 having a mounting surface S disposed at the bottom thereof away from the opposed faces 51A, 51B. In such a case, the folds 55A, 55B are provided at the opening of the recessed groove 46.

As shown in FIGS. 7(*a*) and 7(*b*), as a result of further rotating the crimping piece 50A and the crimping piece 50B, the opposed face 51A of the crimping piece 50A, in particular the protruding portion 51*a*A provided on the opposed face 51A, and the opposed face 51B of the crimping piece 50B, in particular the protruding portion 51*a*B provided on the opposed face 51B, initiate contact with the core wire 97 of the coaxial cable. In addition, as shown in FIG. 7(*a*), the convex portion 53B of the abutting face 52B engages with the recessed portion 54A of the abutting face 52A and, in the same manner, as shown in FIG. 7(*b*), the recessed portion 54B of the abutting face 52B engages with the convex portion 53A of the abutting face 52A.

Subsequently, as shown in FIGS. 8(*a*) and 8(*b*), the crimping piece 50A and the crimping piece 50B become substantially parallel to the mounting surface 21. At such time, the core wire 97 is secured in a crushed state with the help of the protruding portion 51*a*A of the crimping piece 50A and the protruding portion 51*a*B of the crimping piece 50B. In addition, while the convex portion 53B of the abutting face 52B is engaged with the recessed portion 54A of the abutting face 52A and the convex portion 53A of the abutting face 52A is engaged with the recessed portion 54B of the abutting face 52B, these engagement portions are covered by the covering portion 60A provided on the side of the recessed portion 54A opposite to the opposed face 51A as well as by the covering portion 60B provided on the side of the recessed portion 54B opposite to the opposed face 51B. Accordingly, the ingress of dust and the like can be efficiently prevented. In addition, at such time, the collision face 60Aa of the covering portion 60A on the abutting face 52A of the crimping piece 50A and the collision face 60Ba of the covering portion 60B on the abutting face 52B of the crimping piece 50B collide and, as a result of this collision, the crimping piece 50A and the crimping piece 50B travel a small distance in the "γ" direction away from each other. To reduce the angle centered about the folds 55A, 55B formed by each of the opposed faces 51A, 51B and the imaginary plane "S", when the abutting faces 52A, 52B of the crimping pieces 50A, 50B are brought into abutment and allowed to collide, in other words, to delay the timing of collision of the collision face 60Aa formed on the abutting face 52A of the crimping piece 50A and the collision face 60Ba formed on the abutting face 52B of the crimping piece 50B, the angle centered about the fold 55A formed by the imaginary plane "S" and the opposed face 51A as well as the angle centered about the fold 55B formed by the above-described imaginary plane "S" and the opposed face 51B, when the abutting faces 52A, 52B are caused to collide by rotating the paired crimping pieces 50A, 50B, are each set to 45 degrees or less. As a result of configuring such an angle, the dispersion of the force component directed toward the mounting surface 21 and applied to the ceiling surface 56A of the crimping piece 50A and the ceiling surface 56B of the crimping piece 50B via the crimping piece 50A and the crimping piece 50B in the "γ" direction perpendicular thereto is reduced, thereby providing for more efficient transmission in the direction "β". FIG. 7 illustrates a state in which the angle formed by the crimping piece 50A and the imaginary plane "S" and the angle formed by the crimping piece 50B with the imaginary plane "S" are set to approximately 45 degrees. In this embodiment, the collision face 60Aa of the crimping piece 50A and the collision face 60Ba of the crimping piece 50B collide only after the angle exceeds 45 degrees. In such a case, during collision, the load applied to the fold 55A between the crimping piece 50A and the housing 40 and the load applied to the fold 55B between the crimping piece 50B and the housing 40 can be reduced.

A variation of the coaxial cable connector is illustrated in FIGS. 9 to 11. These drawings respectively correspond to FIGS. 5, 7, and 8 of the embodiment discussed above. The same reference numerals are assigned to elements corresponding to the elements illustrated in FIG. 5, etc. Here, however, the letters "C" and "D" are assigned instead of "A" and "B" in order to indicate the right and left sides.

In the variation, the collision face 60C*a* of the crimping piece 50C and the collision face 60Da of the crimping piece 50B are adapted to collide when the angle formed by the crimping piece 50C and the imaginary plane "S" and the angle formed by the crimping piece 50D and the imaginary plane "S" are respectively set to approximately 30 degrees (see FIGS. 10(*a*) and 10(*b*)). However, similar to the embodiment discussed above, the recessed portion 54C and convex portions 53C, which are provided on the abutting face 52C of the crimping piece 50C, and the convex portion 53D and recessed portions 54D, which are provided on the abutting face 52D of the crimping piece 50D, are respectively engaged before the collision face 60Da of the crimping piece 50B collides with the collision face 60C*a* of the crimping piece 50C. With such a configuration, during collision, the load applied to the fold 55C between the crimping piece 50C and the housing 40 and the load applied to the fold 55D between the crimping piece 50D and the housing 40 can be reduced and the core wire 97 can be reliably trapped.

As the volume of data to be transmitted increases, further improvements in radio-frequency characteristics are required. Impedance adjustment becomes a more important factor in terms of improvements in radio-frequency characteristics. Impedance characteristics vary greatly depending on the positional relationship of the outer conductor shell 70 and the core wire 97 of the coaxial cable 9.

Figure 12:
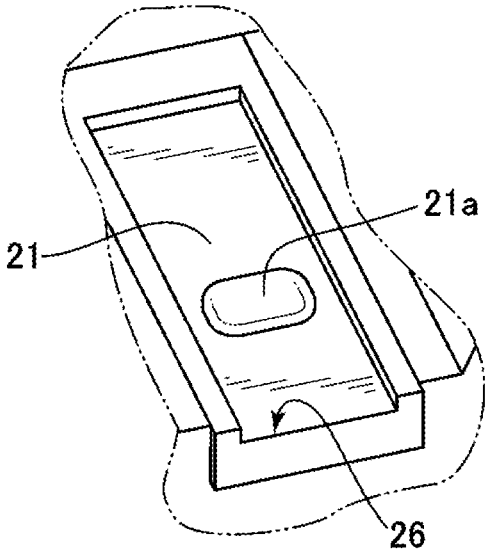

For example, in the configuration of the embodiment, relatively thick material is used as the material of the terminal in order to obtain the necessary contact force in the contact portion 25 of the terminal 20, but as a result, there is a risk that impedance could be reduced and frequency characteristics could be degraded. In the present embodiment, in order to prevent a reduction in impedance while ensuring ample thickness, the thickness of the terminal 20 on the mounting surface 21 in the facing direction "β" is reduced in comparison with the thickness in the facing direction "β" in the section 22 of the terminal 20 adjacent to the mounting surface 21, for example, by crushing the metal sheet, to thereby bring the mounting surface 21 into closer proximity to the opposed faces 51A, 51B than the section 22 of the terminal 20 adjacent to the mounting surface 21. Impedance can be regulated by making the thickness of the terminal 20 on the mounting surface 21 different from the thickness in the section 22 of the terminal 20 adjacent to the mounting surface 21. A variation is illustrated in FIG. 12. This drawing is a partial cutaway perspective cross-sectional view showing the vicinity of the mounting surface 21 of the terminal 20. As shown in FIG. 12, the thickness of the terminal 20 on the mounting surface 21 may be made smaller than the thickness in the section 22 of the terminal 20 adjacent to the mounting surface 21 by providing a depressed indentation 26 in the mounting surface 21.

Quite naturally, the present invention is not limited to the above-described embodiments and allows for various modifications. Therefore, various modifications that would normally occur to one skilled in the art fall within the scope of the inventive claims.

DESCRIPTION OF THE REFERENCE NUMERALS

1 Coaxial cable connector
20 Terminal
21 Mounting surface
24 Connecting portion
25 Contact portion
40 Housing
50A, 50B Crimping pieces
51A, 51B Opposed faces
52A, 52B Abutting faces
55A, 55B Folds
57 Engagement portion
60A, 60B Covering portions
70 Outer conductor shell

The invention claimed is:

1. A coaxial cable connector comprising:
a terminal,
a housing supporting the terminal, and
an outer conductor shell covering at least a portion of the exterior of the housing, wherein
the terminal comprises a mounting surface exposed from the housing;
the housing comprises paired crimping pieces provided on opposed sides that sandwich the mounting surface so as to permit rotation toward the mounting surface, centered about folds;
the paired crimping pieces include, respectively, opposed faces that are opposed to the mounting surface when the paired crimping pieces are rotated and abutting faces brought into abutment against counterpart crimping pieces when the paired crimping pieces are rotated; and
an imaginary plane that passes through folds provided on opposed sides that sandwich the mounting surface is positioned in closer proximity to the opposed faces than to the mounting surface in the facing direction in which the mounting surface and the opposed faces are opposed when the paired crimping pieces are rotated.

2. The coaxial cable connector according to claim 1, wherein the opposed faces that are opposed to the mounting surface when the paired crimping pieces are rotated and the abutting faces brought into abutment with the counterpart crimping pieces when the paired crimping pieces are rotated are capable of colliding with each other.

3. The coaxial cable connector according to claim 1, wherein the angle centered about the folds formed by the opposed faces and the imaginary plane, when the abutting faces of the paired crimping pieces are brought into abutment and allowed to collide, is set to 45 degrees or less.

4. The coaxial cable connector according to claim 1, wherein the housing comprises a recessed groove, in which the mounting surface is disposed, and comprises the above-mentioned folds at the opening of the recessed groove.

5. The coaxial cable connector according to claim 1, wherein recessed portions that engage with convex portions provided on the abutting faces of the counterpart crimping pieces when the paired crimping pieces are rotated are provided on at least any one of the abutting faces of the paired crimping pieces.

6. The coaxial cable connector according to claim 5, wherein covering portions that cover the engagement portions of the convex portions and the recessed portions are provided on the side of the recessed portions opposite to the opposed faces.

7. The coaxial cable connector according to claim 6, wherein the covering portions of the paired crimping pieces collide when the paired crimping pieces are rotated.

8. The coaxial cable connector according to claim 1, wherein the thickness in the facing direction of the terminal on the mounting surface is made to be different from the thickness in the facing direction in the section of the terminal adjacent to the mounting surface.

9. The coaxial cable connector according to claim 8, wherein the mounting surface is brought into closer proximity to the opposed faces than the section of the terminal adjacent to the mounting surface by making the thickness in the facing direction of the terminal on the mounting surface smaller than the thickness in the facing direction in the section of the terminal adjacent to the mounting surface.

10. The coaxial cable connector according to claim 9, wherein the thickness in the facing direction of the terminal on the mounting surface is made smaller than the thickness in the facing direction in the section of the terminal adjacent to the mounting surface by providing a depressed indentation in the mounting surface.

11. The coaxial cable connector according to claim 7, wherein protruding portions that protrude toward the opposed faces are provided in a portion of the mounting surface.

* * * * *